US009741502B2

(12) United States Patent
Zou

(10) Patent No.: US 9,741,502 B2
(45) Date of Patent: Aug. 22, 2017

(54) MECHANICAL AXLE STRUCTURE FOR KEY

(71) Applicant: JIANGSU TRANSIMAGE TECHNOLOGY CO., LTD, Yangzhou, Jiangsu Province (CN)

(72) Inventor: Weimin Zou, Yangzhou (CN)

(73) Assignee: Jiangsu Transimage Technology Co., Ltd., Yangzhou (CN)

( * ) Notice: Subject to any disclaimer, the term of this patent is extended or adjusted under 35 U.S.C. 154(b) by 0 days.

(21) Appl. No.: 15/004,279

(22) Filed: Jan. 22, 2016

(65) Prior Publication Data

US 2017/0194110 A1 Jul. 6, 2017

(30) Foreign Application Priority Data

Dec. 30, 2015 (CN) ..... 2015 1 10187682

(51) Int. Cl.
*H01H 3/12* (2006.01)
*H01H 13/70* (2006.01)

(52) U.S. Cl.
CPC ..... *H01H 3/125* (2013.01); *H01H 13/70* (2013.01)

(58) Field of Classification Search
CPC .. H01H 1/00; H01H 1/12; H01H 1/22; H01H 1/221; H01H 1/225; H01H 3/00; H01H 3/02; H01H 3/12; H01H 13/00; H01H 13/02; H01H 13/70; H01H 13/12; H01H 13/20; H01H 13/50; H01H 13/7006; H01H 13/705; H01H 13/86; H01H 2003/00; H01H 2003/02; H01H 2003/12; H01H 2201/00; H01H 2219/036; H01H 2233/033; H01H 21/36; H01H 36/004; H01H 2221/00; H01H 9/26; H01H 13/72; H01H 13/76; H01H 3/125; H01H 3/70; H01H 3/26; H01H 3/7006; H01H 3/7013; H01H 3/702; H01H 3/705; H01H 2239/056
USPC ..... 200/344, 5 R, 5 A, 46, 406, 511–514, 200/520–521, 308, 310–314, 317, 337, 200/341, 345
See application file for complete search history.

(56) References Cited

U.S. PATENT DOCUMENTS

2010/0252407 A1* 10/2010 Merminod ..... H01H 13/83 200/5 A

* cited by examiner

*Primary Examiner* — Anthony R. Jimenez
(74) *Attorney, Agent, or Firm* — Rankin, Hill & Clark LLP

(57) ABSTRACT

A mechanical axle structure suitable for a key includes a base, a function axle for generating a switch signal and a cover plate. The base, the function axle and the cover plate are connected in order from bottom to top. An upper portion of a supporting piece is fixed with a bottom surface of the cover plate, while a lower portion is fixed with the base. The function axle passes through the supporting piece to support against the bottom surface of the cover plate.

7 Claims, 4 Drawing Sheets

MECHANICAL AXLE STRUCTURE FOR KEY

TECHNICAL FIELD

The invention relates to a mechanical axle structure, and more particular to a mechanical axle structure suitable for a key.

BACKGROUND

In the field of electronic technique, a number of products need to use a key to achieve the switch function, such as a keyboard or a switch and the like, the plurality of keys are pressed to input a signal or a command and transmit to an executing unit, wherein it has very high demands on the operation performance, the pressing life, the key stroke and the operation hand feeling of the key.

For the key used in the thin film keyboard that is easily seen in the market, wherein the axle part playing a role in switching on and off mostly adopts an elastic element, and then is matched with a thin film circuit layer arranged at the bottom. The elastic element is driven by a keycap and triggers the thin film circuit layer downward to generate a signal and the keycap is reset via an elastic force of the elastic element. When pressing, the key stroke is shorter so that the pressing hand feeling is poor. Therefore, the existing keyboard still has many points needing to improve.

In addition, the traditional axle structure used in the mechanical keyboard has a significantly high influence on the game player group in terms of the reaction speed and hand feeling that cannot be achieved by the common keyboard. As the game rises and the competitive game prevails, the demand for the mechanical keyboard is further promoted. But for the traditional mechanical keyboard, the inside mechanical shaft mostly adopts the form of sleeve, which is only suitable for the thicker desktop or externally-connected keyboard. To the thinner and thinner notebook computer keyboard, both the corner hand feeling and function are difficult to meet the user's demands.

SUMMARY OF THE INVENTION

Invention object: the object of the invention is to provide a mechanical axle structure for a key, wherein the mechanical axle structure for the key supports stably and the corner has both better hand feeling and function.

Technical scheme: the mechanical axle structure suitable for the key according to the invention includes a base, a function axle for generating a switch signal and a cover plate, wherein the base, the function axle and the cover plate are connected in order from bottom to top; and further includes a supporting piece, wherein the upper portion of the supporting piece is fixed with the bottom surface of the cover plate, and the lower portion is fixed with the base, and the function shaft passes through the supporting piece to support against the bottom surface of the cover plate.

Wherein, the surface of the base is provided with a connecting portion, the function axle includes a function axle cover sheathed on the outer wall of the connecting portion and can move up and down along the outer wall of the connecting portion, an elastic mechanism is arranged between the function axle cover and the connecting portion; the connecting portion is internally provided with a first spring piece and a second spring piece for achieving the switch function, wherein the function axle cover moves downward to trigger the first spring piece, so that the first spring piece and the second spring piece contact with each other and conduct the circuit to generate a switch signal.

Preferably, the supporting piece includes a pair of scissor pins, and the scissor pin is opened with a central axle hole that is convenient for the switch spindle to pass through.

Particularly, the base is formed by a base plate, and the surface of the base extends outward to form the connecting portion.

Wherein, the function axle cover and the cover plate are an integrally-formed structure.

Further, the outer wall of the upper end of the connecting portion is provided with an upper flange extending outward, the inner wall of the lower end of the function axle cover is provided with a lower flange extending inward, the upper flange is mutually matched with the lower flange to limit the up-and-down motion stroke; the elastic mechanism is a spring mounted between the connecting portion and the function axle cover, wherein the function axle cover moves upward under the action of the resilience force of the spring until the function axle cover stops moving when the lower flange of the function axle cover is buckled with the upper flange of the connecting portion.

Preferably, the bottom surface of the function axle cover is provided with a guide rod axle, the guide rod axle is sheathed with a sliding block sliding up and down, and the sliding block can move up and down along the function axle cover and trigger the first spring piece.

Further, the bottom of the cover plate is provided with an upper snap, the base is provided with a lower snap, and the scissor pins are coupled with the upper snap and the lower snap respectively.

Working principle: when the mechanical axle structure suitable for the key according to the invention is working, an acting force is transmitted to the function axle cover when applying a pressure on the cover plate, the function axle cover moves downward at a section of distance to touch the sliding block and drives the sliding block to move downward together, the sliding block triggers the first spring piece, the elastic force of the first spring piece gradually increases and then gradually reduces after achieving the peak point, at this time, the first spring piece and the second spring piece contact with each other and conduct the circuit to generate a switch signal; and the sliding block makes a knocking noise when falling down, so it has stronger section feeling. When removing the acting force applied to the cover plate, the function axle cover is sprung up due to the resilience force and drives the sliding block to move upward together, but the sliding block is blocked when moving to a certain position, the function axle cover continues to spring up until the function axle cover stops moving to return to the initial position when the lower flange of the axle cover is buckled with the upper flange of the connecting portion.

Beneficial effect: compared to the prior art, the invention has the remarkable advantages that: first, for the mechanical axle structure suitable for the key according to the invention, the mechanical axle structure supports more stably and has a longer service life by adding a scissor structure, and the corner has better hand feeling and function as well; second, the structure can be used for a keyboard with a shorter stroke, so that the keyboard is thinner and lighter and is more widely applied in the market.

DETAILED DESCRIPTION OF THE PREFERRED EMBODIMENTS

The technical scheme of the invention will be further described hereinafter with reference to the drawings.

At present, a traditional mechanical keyboard is generally composed of a base plate 1, a function axle 2 and a cover plate 3, which are arranged from bottom to top. The cover plate 3 is sheathed above the function axle 2, the structure of the function axle 2 is more tedious; moreover, the structure of the function axle 2 is only suitable for thicker desktop or externally connected keyboard, the application scope is small, and the supporting performance is pool, so it fails to adapt to the keyboard with a shorter stroke.

Figure 1:
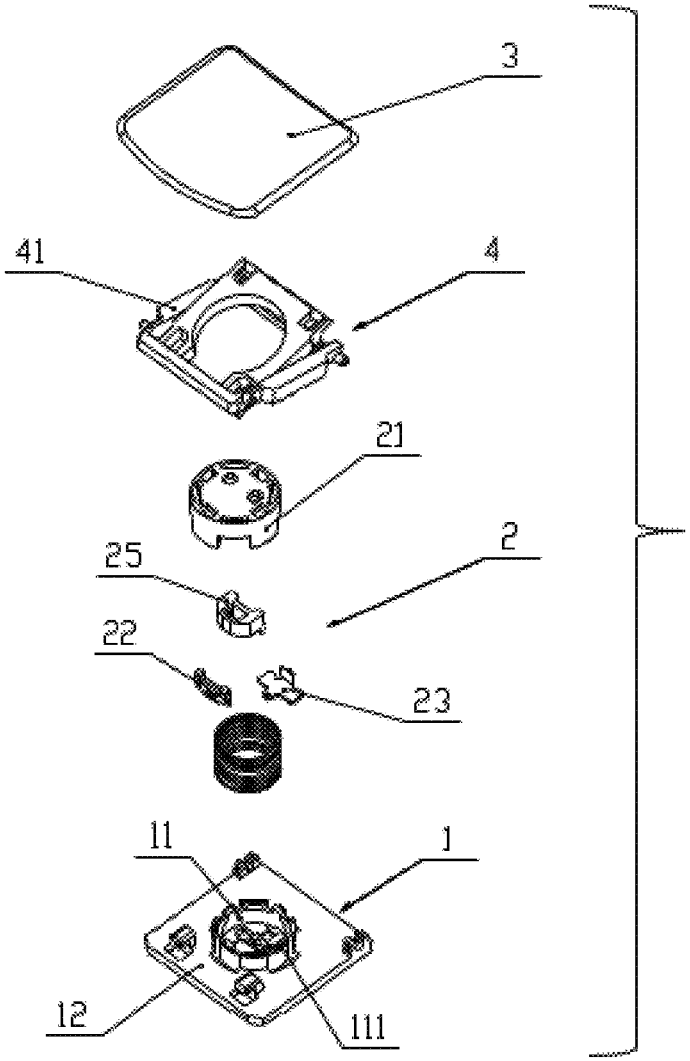
FIG. 1 is an assembling diagram of the invention.
Figure 4:
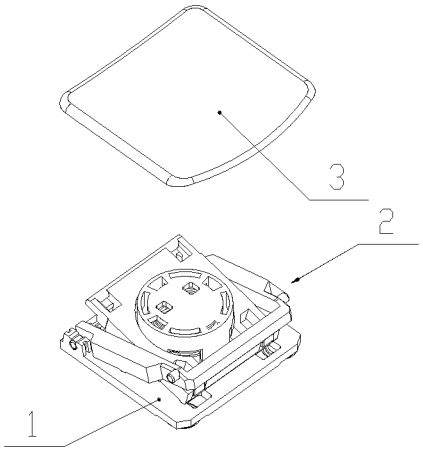
FIG. 4 is a schematic structural diagram of a cover plate of the invention while mounting.

As shown in FIG. 1 and FIG. 4, the invention discloses a mechanical axle structure suitable for a key, including a base 1, a function axle 2 and a cover plate 3, wherein the base 1, the function axle 2 and the cover plate 3 are connected in order from bottom to top, the function shaft 2 is used for generating a switch signal; the mechanical axle structure further includes a supporting piece 4, wherein the upper portion of the supporting piece 4 is fixed with the bottom surface of the cover plate 3, while the lower portion is fixed with the base 1, and the function axle 2 passes through the supporting piece 4 to support against the bottom surface of the cover plate 3.

Figure 3:
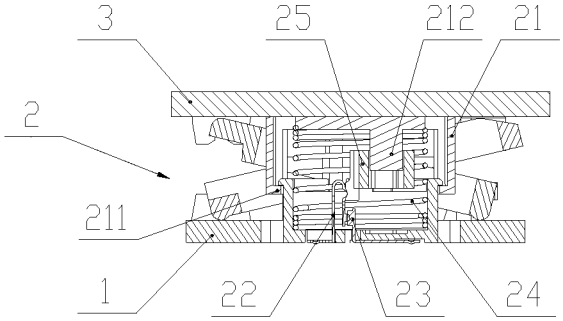
FIG. 3 is a sectional view of the invention.
Figure 7:
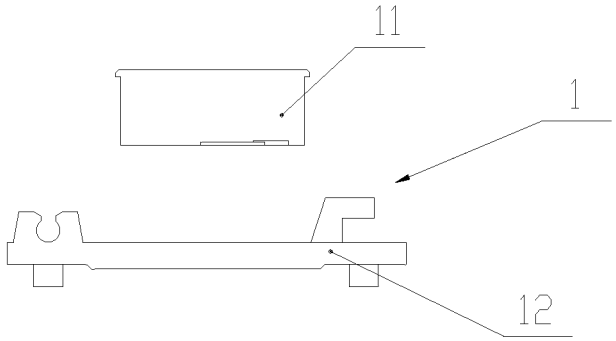
FIG. 7 is a schematic structural diagram of a base and a connecting portion mounting as mutually independent parts in the invention.
Figure 8:
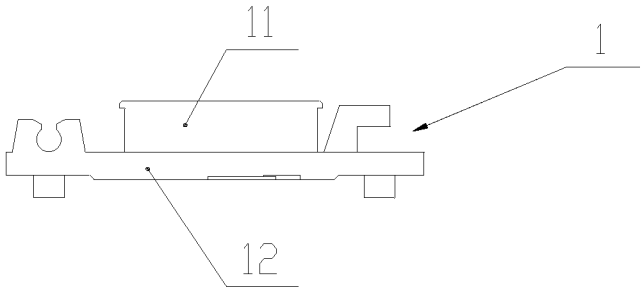
FIG. 8 is a schematic structural diagram of a base and a connecting portion as integral parts in the invention.
Figure 9:
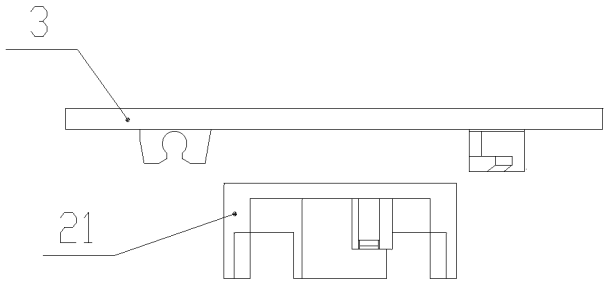
FIG. 9 is a schematic structural diagram of a function axle cover and a cover plate mounting as mutually independent parts in the invention.
Figure 10:
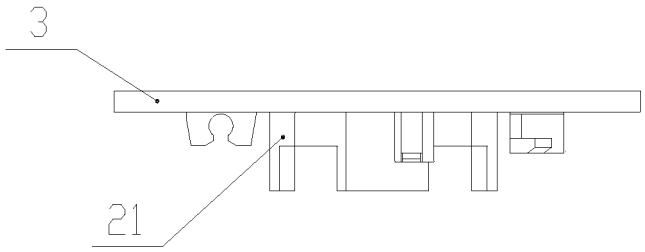
FIG. 10 is a schematic structural diagram of a function axle cover and a cover plate as integral parts in the invention.
Figure 11:
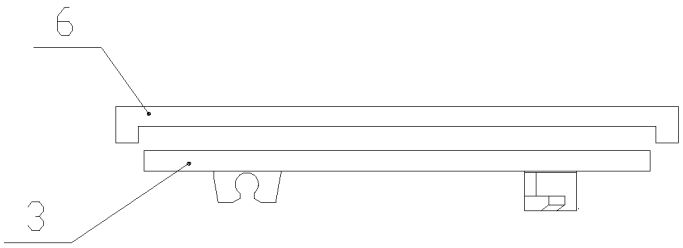
FIG. 11 is a schematic structural diagram of a cover plate and an applicable product pressing plate when mounting in the invention.
Figure 12:
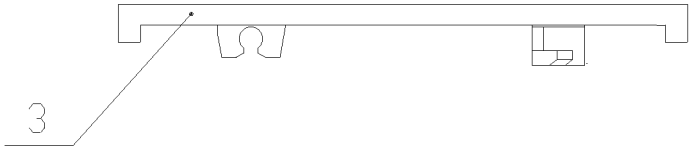
FIG. 12 is a schematic structural diagram of a cover plate and a product pressing plate as integral parts in the invention.
Figure 13:
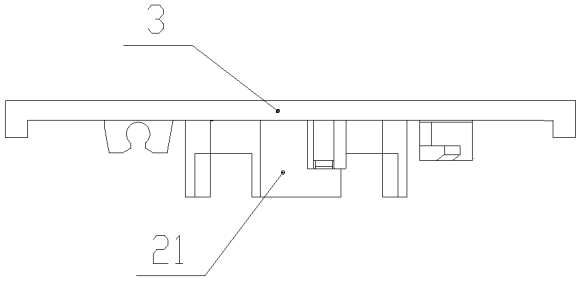
FIG. 13 is a schematic structural diagram of a function axle cover, a cover plate and a product pressing plate as integral parts in the invention.

As shown in FIG. 1 and FIG. 3, the surface of the base 1 is provided with a connecting portion 11, wherein the base 1 is formed by a base plate 12, the connecting portion 11 can be used as an independent part to arrange on the base plate 12, as shown in FIG. 7; the connecting portion 11 can also be integrally formed with the base plate 12, and the surface of the base plate 11 extends outward to form the connecting portion 11, as shown in FIG. 8. The function shaft 2 includes a function axle cover 21 sheathed on the outer wall of the connecting portion 11 and can move up and down along the outer wall of the connecting portion 11. The outer wall of the upper end of the connecting portion 11 is provided with an upper flange 111 extending outward, the inner wall of the lower end of the function axle cover 21 is provided with a lower flange 211 extending inward, and the upper flange 111 and the lower flange 211 are mutually matched with each other to limit the up-and-down motion stroke. The elastic mechanism 24 is a spring mounted between the connecting portion 11 and the function axle cover 21, wherein the function axle cover 21 moves upward under the action of the resilience force of the spring until the function axle cover 21 stops moving when the lower flange 211 of the function axle cover is buckled with the upper flange 111 of the connecting portion. The bottom surface of the function axle cover 21 is provided with a guide rod axle 212, the guide rod axle 212 is sheathed with a sliding block 25 sliding up and down, and the sliding block 25 can move up and down along with the function axle cover 21 and trigger the first spring piece 22. Wherein the function axle cover 21 and the cover plate 3 can be an integrally-formed structure, as shown in FIG. 10; the function axle cover 21 and the cover plate 3 can also be used as mutually independent parts for fitting use, as shown in FIG. 9. The mechanical axle according to the invention can be equipped with a corresponding product pressing plate 6, the product pressing plate 6 can be used as an independent part to be matched with the cover plate 3 for use, as shown in FIG. 11; at the same time, the product pressing plate 6 and the cover plate 3 can be an integrated structure, that is to say the cover plate has the function of a product pressing rod as well, as shown in FIG. 12; on this basis, the product pressing plate 6, the cover plate 3 and the function axle cover 21 can further be integrally formed, as shown in FIG. 13.

Figure 5:
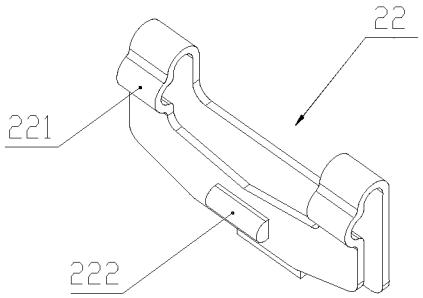
FIG. 5 is a schematic structural diagram of a first spring piece in the invention.
Figure 6:
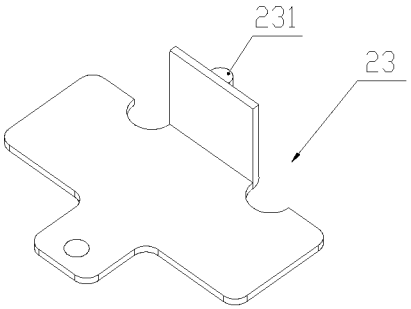
FIG. 6 is a schematic structural diagram of a second spring piece in the invention.

As shown in FIG. 3, according to the invention, the base 1 located in the connecting portion 11 internally is provided with a first spring piece 22 and a second spring piece 23, the upper end of the first spring piece 22 is provided with a arc 221 that is bent and formed by itself, the lower end of the first spring piece 22 is provided with a left contact portion 222, the second spring piece 23 is provided with a right contact portion 231, and the arc 221 is matched with the groove 251 on the sliding block 25 when the key is not pressed, at this time, the left contact portion 222 does not contact with the right contact portion 231, and the switch is disconnected, as shown in FIG. 5 and FIG. 6. When the cover plate is applied with force by the user, the function axle cover 21 moves downward at a section of distance to touch the sliding block 25 and drives the sliding block 25 to move downward together, the sliding block 25 triggers the first spring piece 22, the elastic force of the first spring piece 22 gradually increases and then gradually reduces after achieving the peak point, at this time, the left contact portion 222 on the first spring piece 22 and the right contact portion 231 on the second spring piece 23 contact and communicate the circuit to generate a switch signal; and the sliding block 25 makes a knocking noise when falling down, so it has stronger section feeling. When the user removes the pressure applied on the cover plate 3, the function axle cover 21 is sprung up due to the resilience force and drives the sliding block 25 to move upward together, but the groove 251 of the sliding block 25 is matched with the arc 221 on the first spring piece 22, the sliding block 25 is blocked by the first spring piece 22 when moving to a certain position, the function axle cover 21 continues to spring up until the function axle cover 21 and the cover plate 3 stop moving to return to the initial position when the lower flange 211 of the function axle cover 21 is buckled with the upper flange 111 of the connecting portion.

Figure 2:
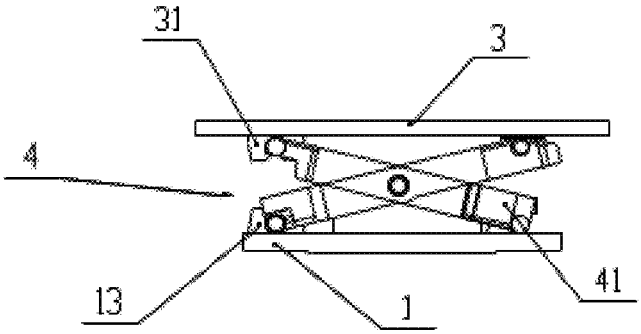
FIG. 2 is a schematic structural diagram of the invention.

As shown in FIG. 1 and FIG. 2, in order to increase the stability of the cover plate 3 when being pressed, the mechanical axle structure suitable for the key according to the invention discloses a supporting piece 4, the supporting piece 4 includes a pair of scissor pins 41, and the scissor pin 41 is opened with a central axle hole convenient for the function axle 2 to pass through. Wherein the bottom of the cover plate 3 is provided with an upper snap 31, the scissor pin 41 is coupled with the upper snap 31 of the cover plate to assist the cover plate 3 in smoothly dropping when being pressed. The base 1 is provided with a lower snap 13, the scissor pin 41 is coupled with the lower snap 13 to fix the base 1 and the scissor pin 41.

The supporting plate 4 not only can connect the cover plate 3 with the supporting plate 1 and drive the function axle 2 to move up and down, but also enable the cover plate 3 to uniformly disperse the pressure when the cover plate 3 is pressed, so as to improve the trigger sensitivity of the mechanical switch and the stability of the key.

The invention claimed is:

1. A mechanical axle structure for a key, comprising a base, a function axle for generating a switch signal and a cover plate, wherein the base, the function axle and the cover plate are connected in order from bottom to top; and the mechanical axle structure further comprises a supporting piece, an upper portion of the supporting piece is fixed with a bottom surface of the cover plate, while a lower portion is fixed with the base, and the function axle passes through the supporting piece to support against the bottom surface of the cover plate, wherein an upper surface of the base is provided with a connecting portion, the function axle comprises a function axle cover sheathed on an outer wall of the connecting portion and movable up and down along the outer wall of the connecting portion, an elastic mechanism is arranged between the function axle cover and the connecting portion; the connecting portion is internally provided with a first spring piece and a second spring piece, which are used for achieving a switch function, wherein the function axle cover moves downward to trigger the first spring piece, so that the first spring piece and the second spring piece contact with each other and close a circuit to generate a switch signal.

2. The mechanical axle structure for the key according to claim 1, wherein the base is formed by a base plate, and the upper surface of the base plate extends outward to form the connecting portion.

3. The mechanical axle structure for the key according to claim 1, wherein the function axle cover and the cover plate are an integrally-formed structure.

4. The mechanical axle structure for the key according to claim 1, wherein the outer wall of the upper end of the connecting portion is provided with an upper flange extending outward, an inner wall of a lower end of the function axle cover is provided with a lower flange extending inward, the upper flange and the lower flange are mutually matched with each other to limit an up-and-down motion stroke; the elastic mechanism is a spring mounted between the connecting portion and the function axle cover, wherein the function axle cover moves upward under the action of the resilience force of the spring until the function axle cover stops moving when the lower flange of the function axle cover is buckled with the upper flange of the connecting portion.

5. The mechanical axle structure for the key according to claim 1, wherein a bottom surface of the function axle cover is provided with a guide rod axle, the guide rod axle is sheathed with a sliding block sliding up and down, and the sliding block is movable up and down along with the function axle cover and triggers the first spring piece.

6. The mechanical axle structure according to claim 1, wherein the supporting piece comprises a pair of scissor pins opened with a central axle hole for the function axle to pass through.

7. The mechanical axle structure for the key according to claim 6, wherein the bottom of the cover plate is provided with an upper snap, the base is provided with a lower snap, and the scissor pins are coupled with the upper snap and the lower snap respectively.

* * * * *